US006371035B1

(12) United States Patent
Schiedegger et al.

(10) Patent No.: US 6,371,035 B1
(45) Date of Patent: Apr. 16, 2002

(54) STORAGE DEVICE

(75) Inventors: Jeffery E. Schiedegger, Ann Arbor, MI (US); Eric P. Chan, New York, NY (US)

(73) Assignee: Herman Miller Inc., Zeeland, MI (US)

( * ) Notice: Subject to any disclaimer, the term of this patent is extended or adjusted under 35 U.S.C. 154(b) by 0 days.

(21) Appl. No.: 09/572,215

(22) Filed: May 17, 2000

Related U.S. Application Data

(60) Provisional application No. 60/137,830, filed on Jun. 6, 1999.

(51) Int. Cl.[7] ..... A47B 47/00
(52) U.S. Cl. ..... 108/180; 211/183
(58) Field of Search ..... 108/180, 188, 108/159, 183, 113; 211/153, 186, 189; 248/247, 250; 312/264

(56) References Cited

U.S. PATENT DOCUMENTS 1,929,319 A * 10/1933 Korb ..... 108/188
2,941,582 A * 6/1960 Tomat ..... 108/115
3,827,377 A 8/1974 Aughtry
3,967,327 A * 7/1976 Severson ..... 108/188
4,044,448 A * 8/1977 Watanabe et al. ..... 248/239

FOREIGN PATENT DOCUMENTS

FR 979082 * 4/1951 ..... 312/264

OTHER PUBLICATIONS

International Search Report, completed Sep. 11, 2000 for International Application No. PCT/US00/14983.

* cited by examiner

*Primary Examiner*—Peter M. Cuomo
*Assistant Examiner*—Jerry A. Anderson
(74) *Attorney, Agent, or Firm*—Brinks Hofer Gilson & Lione

(57) ABSTRACT

A storage device including two opposing side panels, a plurality of shelves and a plurality of crossed support devices. The plurality of shelves interconnect the side panels. The plurality of crossed support devices are capable of being attached to one of a first opening and a second opening. The first opening and the second opening are located opposite one another and provide access to an interior cavity capable of supporting storage materials.

17 Claims, 5 Drawing Sheets

STORAGE DEVICE

RELATED APPLICATION

This application claims the benefit of the filing date pursuant to 35 U.S.C. §119(e) of Provisional application Ser. No. 60/137,830, filed Jun. 6, 1999, the disclosure of which is hereby incorporated by reference.

FIELD OF THE INVENTION

The present invention relates to the field of storage devices. More particularly, the invention relates to a storage device having improved stability with easy access from two opposing sides.

BACKGROUND OF THE INVENTION

In many work environments, two employees work in closely spaced adjacent work areas. These works areas often include elements such a desk or a meeting table. However, many times a worker needs additional space for the storage of materials such as books or papers. While two storage devices such as traditional book shelves can be positioned adjacent each other such that each user can place work objects therein, this configuration can involve a somewhat wasteful use of space if only one bookshelf is necessary. Yet, two bookshelves have previously been necessary because they are not designed to provide access from two opposing directions. Rather, traditional bookshelves generally include a rear panel that prevents access to the bookshelf from the rear. This rear panel is necessary to provide the bookshelf with the required stability.

Therefore, there is a need for an improved storage device which has the required stability while also being capable of being accessed from two opposing directions. This storage device must also be capable of easy assembly while being easily constructed in a cost-efficient manner.

SUMMARY OF THE INVENTION

The present invention is directed to an improved storage device that provides easy access from two opposing sides while also capable of being easily reconfigured and assembled.

According to a first aspect of the present invention, a storage device is provided. The storage device includes two opposing side panels, a plurality of shelves and a plurality of crossed support devices. The plurality of shelves interconnect the side panels. The plurality of crossed support devices are capable of being attached to one of a first opening and a second opening. The first opening and the second opening are located opposite one another and provide access to an interior cavity capable of supporting storage materials.

According to another aspect of the invention, a storage device is provided. The storage device includes two opposing side panels, a plurality of shelves and a plurality of crossed support cables. The plurality of crossed support cables are capable of being attached to one of a first opening and a second opening. The first opening and the second opening are located opposite one another and provide access to an interior cavity capable of supporting storage materials. The cables can be adjustably secured to impart a tension to the side panels thereby providing an improved stability to the storage device.

According to a further aspect of the invention, a storage device is provided. The storage device includes two opposing side panels, a plurality of shelves and a plurality of crossed support cables. The two opposing side panels have a vertical channel extending along the ends thereof. A plurality of shelves interconnect the side panels. A plurality of crossed support devices are capable of being attached to one of a first opening and a second opening. The first opening and the second opening are located opposite one another and provide access to an interior cavity capable of supporting storage.

The present invention, together with attendant objects and advantages, will be best understood with reference to the detailed description below in connection with the attached drawings.

DETAILED DESCRIPTION OF THE PREFERRED EMBODIMENTS

Figure 1:
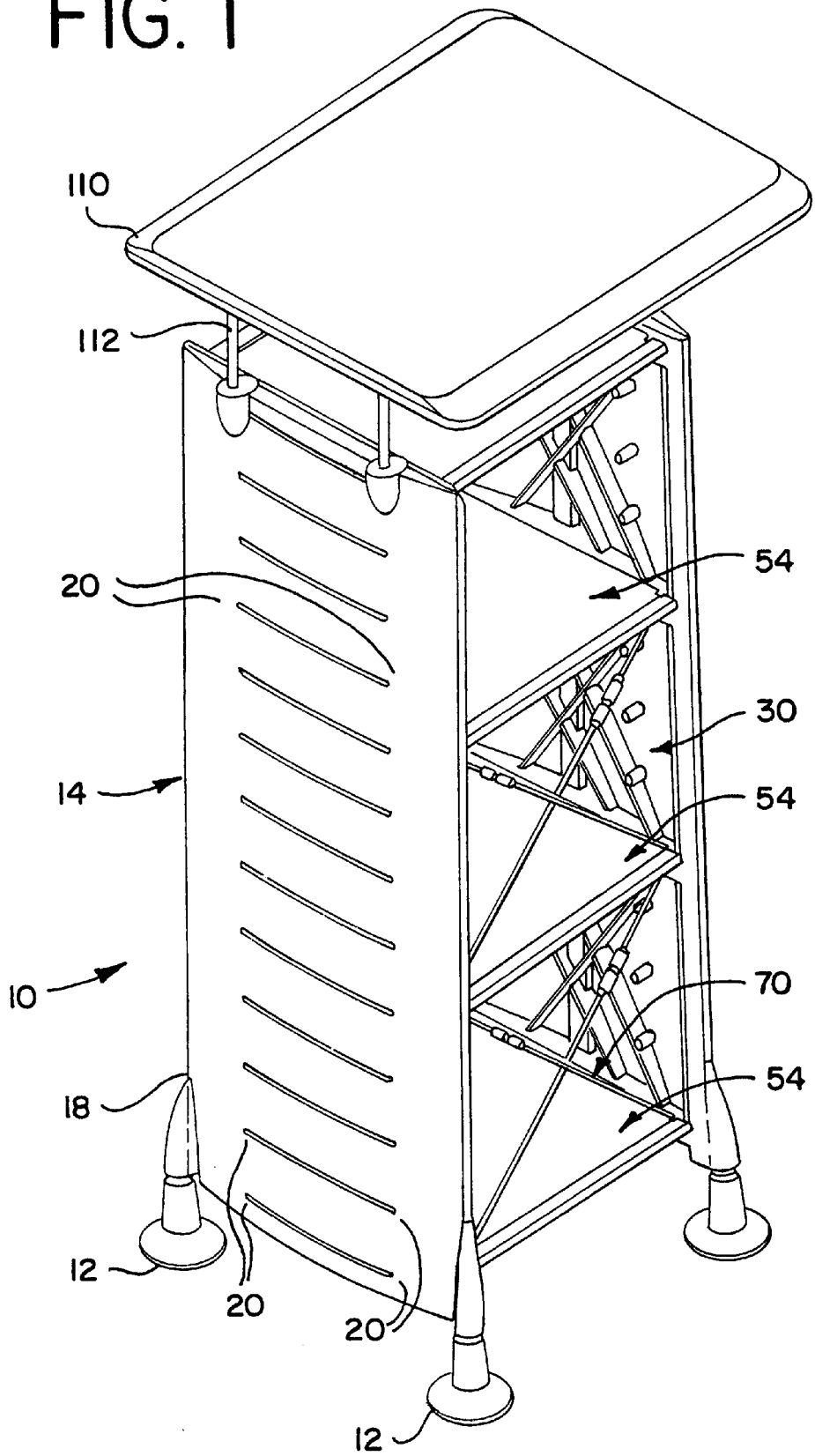
FIG. 1 is a perspective view of a storage device constructed in accordance with a first preferred embodiment.
Figure 2:
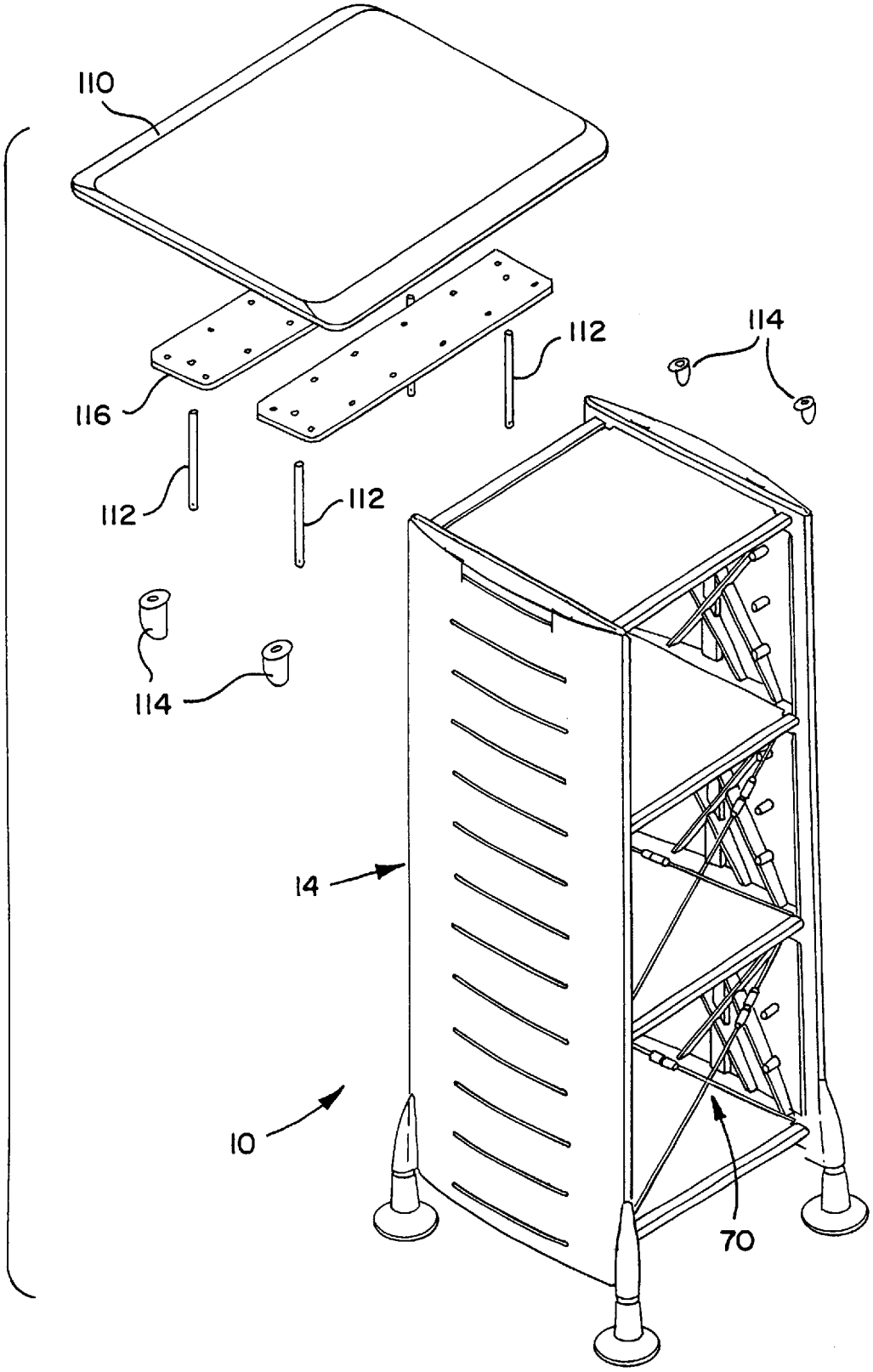
FIG. 2 is a partially exploded view of the preferred embodiment illustrated in FIG. 1.

FIG. 1 is an illustration of a storage device 10 constructed in accordance with a first preferred embodiment of the invention. It should be recognized that the storage device 10 can be constructed in a wide variety of sizes and alternate configurations without departing from the spirit of the present invention. For example, while the storage device 10 illustrated in the drawings includes four shelves and a top work surface, the present invention may also be embodied with two, or three shelves. The present invention could also be constructed without the top work surface. In addition, the shelves may be constructed to have a wide variety of widths.

With reference to FIG. 1, storage device 10 is shown having feet 12. The feet 12 are preferably manufactured from a thermoplastic polymer material. In the alternative, the feet 12 could be constructed using casters to provide the storage device 10 with easier movability. The feet 12 are connected to side panels 14. The feet 12 include a threaded top portion that is fit within a leg 16 extending from a lower portion 18 of the side panel 14.

The side panel 14 is preferably manufactured from a thermoplastic polymer. A low-pressure gas assist molding press is preferably used to manufacture the side panels 14. The side panels 14 include a plurality of vertically aligned pairs of apertures 20. The apertures 20 are adapted to receive an attachment portion of a utility piece, such as a paper tray. This feature is particularly useful when the storage member 10 is positioned adjacent the work surface of a user.

Figure 3:
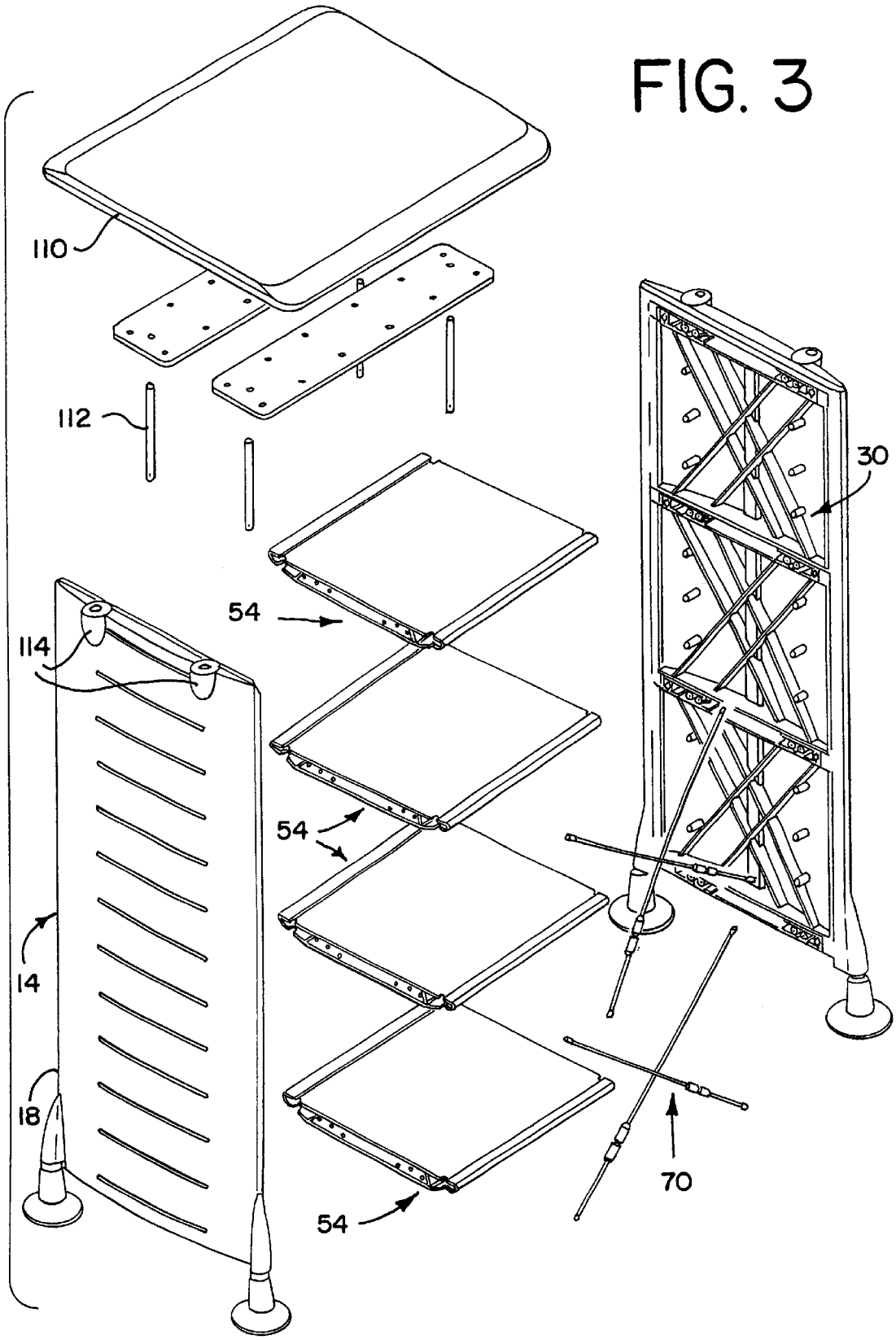
FIG. 3 is an exploded view of the embodiment illustrated in FIGS. 1 and 2.
Figure 5:
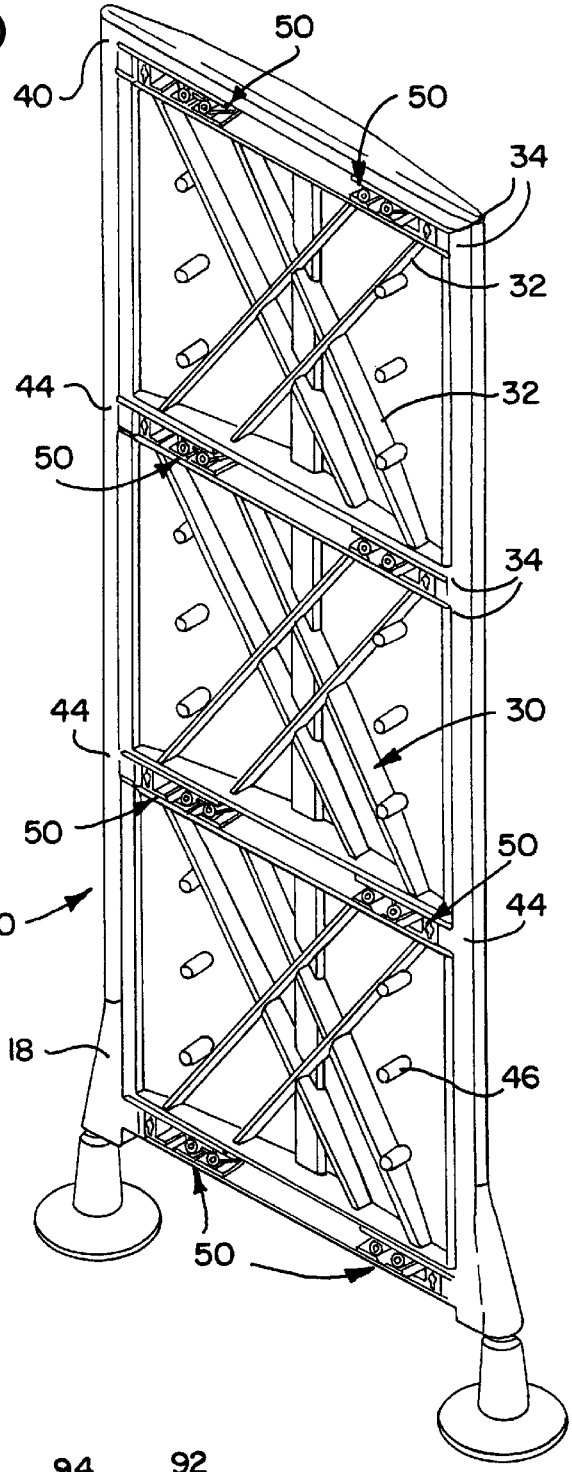
FIG. 5 is an inner perspective view of a side panel in accordance with a preferred embodiment.

The side panels 14 include an inner side 30 that is best illustrated in FIGS. 3 & 5. The inner side 30 includes a plurality of crisscrossed ribs 32 that provide support the storage device 10. A plurality of spaced pairs of horizontally extending ribs 34 extend intermittently between a top portion 40 and the lower portion 18 of the side panel 14. The horizontal ribs 34 include end portions 44. A plurality of passageways 46 extend coaxially with the apertures 20.

Figure 6:
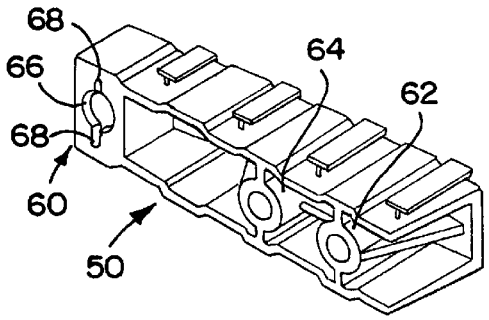
FIG. 6 is a perspective view of a preferred embodiment of an insert.

Inserts 50 are best illustrated in FIGS. 5 and 6. The inserts 50 are positioned adjacent to each end portion 44 of the horizontal ribs 34. The inserts 50 are molded into the side panel 12 during manufacture thereof. There are two inserts 50 molded into each side panel 14 at each tier such that four inserts 50 are adjacent each shelf 54. In the preferred embodiment, the insert 50 is formed from an alloy material and manufactured using a permanent mold.

With particular reference to FIG. 6, the insert 50 includes a double keyhole opening 60, a screw boss 62 and a utility hole 64. The double keyhole opening 62 includes a central and generally circular opening 66 with the narrow channels 68 extending above and beneath the circular opening 66. The screw boss 62 includes an interior surface to receive a thread-cutting screw (not shown). The utility hole 64 is a smooth passageway adapted to receive the attachment portion of a utility member that extends through a coaxial aperture 20. The double keyhole opening 60 serves as the attachment point for the support cables 70.

Figure 7:
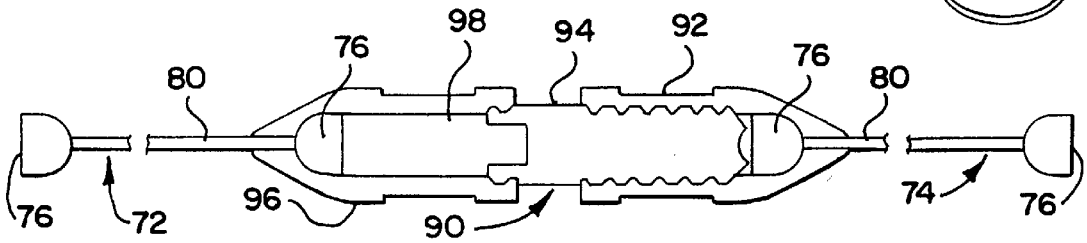
FIG. 7 is a partially broken away view of the preferred embodiment of the cable connection assembly.

The support cables 70 are best illustrated in FIGS. 1–4, and 7. With particular reference to FIG. 7, the support cables 70 include a first piece 72 and a second piece 74. At each end of each piece 72, 74, a rounded end portion 76 is fixedly attached to the cable. The rounded end portion 76 is preferably formed from an alloy material and die cast onto an end of the cable. In the preferred embodiment, a steel wire body 80 interconnects the end portions 76. The length of the body 80 can be adjusted to suit the varying widths of the storage devices 10 that can be constructed in accordance with the present invention. The first piece 72 is approximately 4" long in the preferred embodiment. The second piece 74 extends the balance of the length from the first side of the storage device 10 to the second side of the storage device 10.

A bullet-shaped connector 90 interconnects the first piece 72 and the second piece 74. The connector 90 provides for a connection between the first piece 72 and second piece 74. The connector 90 includes a first member 92 having a threaded end 94 adapted to be received within the second member 96. The first member 92 and second member 96 can rotate with respect to the bodies 80 of the first piece 72 and the second piece 74. The threaded end 94 is adapted to be screwed into a boss 98 within the second member 96. As a result, the support cables 70 impart the required stress to the storage device 10 to thereby improve its stability. The connector 90 is preferably formed from cold rolled steel with a plated finish. The first member 92 and the second member 96 are slid onto the cable during manufacture thereof and retained by the end portions 76.

Figure 4:
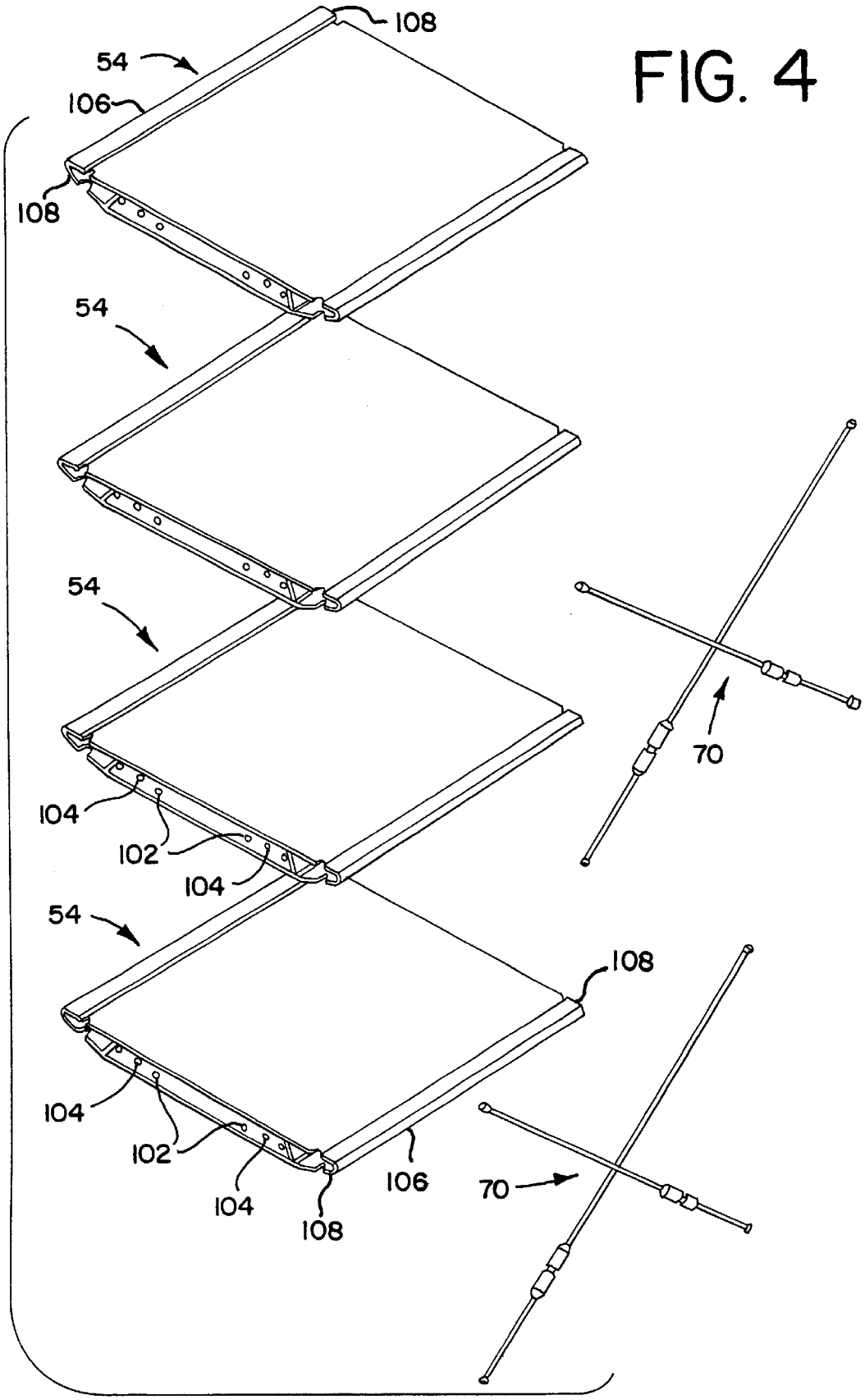
FIG. 4 is an exploded view of the shelves and support cables in accordance with a preferred embodiment.

Shelves 54 interconnect the side panels 14. Shelves 54 are preferably manufactured from a steel material. The shelves 54 include a plurality of apertures 102 as shown in FIG. 4. The apertures 102 provide the passageway for screws (not shown) which pass through the shelves 54 and into the screw bosses 62 within the inserts 50. In this manner, the shelves 54 are attached to side panels 14 of the storage device 10. A second set of apertures 104 are aligned with the utility holes 64 for use with a utility member. The shelves 54 include a ridge 106 that passes horizontally along end portions 108 thereof. Support cables 70 are aligned with the ridges 106. The ridge 106 can also be used as a mounting feature for a tool or prevent a work object from being pushed off the shelf 54.

A top work surface portion 110 is illustrated in the FIGURES of this preferred embodiment. The work surface 110 is attached to the support rods 112. The support rods 112 are mounted to aluminum mounting members 114 which are attached to an upper portion of the side panels 14. The work surface 110 includes a bottom portion having a steel plate 116 extending thereacross. The steel plate 116 is welded to the support rods 112. The steel plate 116 further includes additional openings that allow fasteners to passed into the work surface 110. The work surface 110 can be constructed from a wide variety of materials including wood.

The storage device 10 is assembled securing the shelves 54 to the side panels 14 using screws which pass through apertures 102 into the screw bosses 62 in the inserts 50. Feet 12 are secured to the lower portion 18 of the side panel 14. The round end portions 76 of the cables 70 are fit within the double keyhole opening 60 of the inserts 50, The body portion 80 passes through one of the narrow channels 68. The first member 92 and the second member 96 are connected by threading the threaded end 94 into the boss 98. The body portions 80 are sized such that when the first member 92 and the second member 96 are screwed together that the proper tension is imparted to the storage device 10. The work surface 110 is screwed to steel plate 116 which is welded to the support rods 112.

The storage device 10 is designed such that a user could remove the support cables 70 from one opposing side of the storage device and reattach the support cables 70 to an opposing side. The support cables 70 would then be located on opposite sides of the storage device such that the storage device 10 could be used by two workers in adjacent work spaces.

The embodiments described above and shown herein are illustrative and not restrictive. The scope of the invention is indicated by the claims rather than by the foregoing description and attached drawings. The invention may be embodied in other specific forms without departing from the spirit of the invention. For example, the storage device may be configured to provide a wide variety of vertical and horizontal sizes without departing from the claimed invention. Accordingly, these and any other changes which come within the scope of the claims are intended to be embraced herein.

We claim:

1. A storage device comprising:

(a) a first side panel and a second opposing side panel;

(b) a plurality of shelves interconnecting the side panels; and (c) a plurality of crossed support devices, each support device capable of being attached at one end to a first opening in a first insert connected to the first panel and at another end to a second opening in a second insert connected to the second side panel, said ends being readily removable from said openings.

2. The storage device of claim 1 wherein the plurality of crossed support devices are formed from wire.

3. The storage device of claim 2 wherein each crossed support device is formed from two pieces.

4. The storage device of claim 3 wherein a connection device interconnects the two pieces.

5. The storage device of claim 4 wherein the connection device includes a first connection device and a second connection device, the first connection device being threaded and the second connection device adapted to receive the first connection device.

6. The storage device of claim 5 wherein the first insert and the second insert are positioned in each side panel adjacent each shelf.

7. The storage device of claim 6 wherein the first and second openings in the first and second inserts are double keyhole-shaped openings, said inserts further including a screw boss.

8. //The storage device of claim 7 wherein each end of the crossed support devices has a curved end received bV the keyhole opening.

9. The storage device of claim 8 further comprising a screw passing through each shelf and into the screw boss of the insert.

10. A storage device comprising:

(a) a first side panel and a second opposing side panel;

(b) a plurality of shelves interconnecting the side panels; and (c) a plurality of crossed support cables, each being attached at one end to a first opening in a first insert connected to the first side panel and at another end to a second opening in a second insert connected to the second side panel, said ends being readily removable from said openings, the cables capable of being adjustably secured to impart a tension to the side panels whereby the storage device is provided with an increased stability.

11. The storage device of claim 10 wherein the cables are formed from wire.

12. The storage device of claim 11 wherein each cable is formed from two pieces.

13. The storage device of claim 12 wherein the cables are adjustably secured through the use of a first connection device and a second connection device, the first connection device being threaded and the second connection device adapted to receive the first connection device.

14. The storage device of claim 13 wherein the side panels include a plurality of aligned apertures adapted to receive a utility member.

15. The storage device of claim 14 wherein the first and second inserts are molded into the first and second side panels, respectively.

16. The storage device of claim 15 wherein the first and second inserts each include a double keyhole-shaped opening, a screw boss and a utility hole.

17. The storage device of claim 16 wherein one end of each cable is received by the keyhole opening, the screw hole is adapted to receive a screw passing through a shelf into the insert and the utility hole is adapted to receive an attachment portion extending from a utility member.

* * * * *